US009091509B2

(12) United States Patent
Gettle et al.

(10) Patent No.: US 9,091,509 B2
(45) Date of Patent: Jul. 28, 2015

(54) ARMOR ASSEMBLY

(76) Inventors: Guy Leath Gettle, Alamo, CA (US); James Michael Kurtz, St. Petersburg, FL (US)

( * ) Notice: Subject to any disclaimer, the term of this patent is extended or adjusted under 35 U.S.C. 154(b) by 67 days.

(21) Appl. No.: 13/883,513

(22) PCT Filed: Nov. 4, 2011

(86) PCT No.: PCT/US2011/001862

§ 371 (c)(1), (2), (4) Date: May 3, 2013

(87) PCT Pub. No.: WO2012/087344

PCT Pub. Date: Jun. 28, 2012

(65) Prior Publication Data

US 2013/0220107 A1 Aug. 29, 2013

Related U.S. Application Data

(60) Provisional application No. 61/456,487, filed on Nov. 5, 2010.

(51) Int. Cl.
*F41H 5/02* (2006.01)
*F41H 5/04* (2006.01)

(52) U.S. Cl.
CPC ..... *F41H 5/04* (2013.01); *F41H 5/0428* (2013.01); *F41H 5/0492* (2013.01); *Y10T 156/10* (2015.01)

(58) Field of Classification Search
CPC . Y10S 428/911; F41H 5/0485; F41H 5/0492; B32B 2571/00
USPC ..... 89/36.01–36.17, 904, 914–916; 428/911; 109/49.5
See application file for complete search history.

(56) References Cited

U.S. PATENT DOCUMENTS

| | | | | |
|---|---|---|---|---|
| 5,804,757 | A * | 9/1998 | Wynne | 89/36.05 |
| 6,911,247 | B2 * | 6/2005 | Howland | 428/114 |
| 2005/0188831 | A1 * | 9/2005 | Squires et al. | 89/36.02 |
| 2006/0037463 | A1 * | 2/2006 | Vittoser et al. | 89/36.02 |
| 2008/0307553 | A1 * | 12/2008 | Jbeili et al. | 2/2.5 |
| 2010/0212486 | A1 * | 8/2010 | Kurtz et al. | 89/36.02 |
| 2014/0290474 | A1 * | 10/2014 | Citterio et al. | 89/36.02 |

* cited by examiner

*Primary Examiner* — Samir Abdosh
(74) *Attorney, Agent, or Firm* — Jeffrey R. Ramberg

(57) ABSTRACT

An armor assembly for providing resistance to penetration by projectiles includes an impact surface or strike face layer featuring an organic resin composite into which multitudinous ceramic shapes are distributed, a secondary or transition layer to provide mechanical support to the strike face and distribute the imposed load over a wider bearing area, a spacer layer that facilitates reflection of stress waves in the assembly layers between the space and incident projectile, and a back surface that defines the space as well as intercepts any projectile or projectile fragments transiting the space so defined. To this basic assembly can be added components that increase deformation and deflection of incident projectiles, reduce transmitted stresses, or strengthen at least one of the layers.

24 Claims, 3 Drawing Sheets

ARMOR ASSEMBLY

CROSS-REFERENCE TO RELATED APPLICATIONS

None.

TECHNICAL FIELD

This invention relates to armor assemblies that can be used for preventing penetration by impacting objects, and specifically to armor assemblies used to protect structures, people, automotive vehicles, and aircraft against supersonic projectiles.

BACKGROUND ART

People, vehicles, aircraft and ships may be exposed to projectiles launched from barreled weapons such as guns. Potential targets may also be exposed to projectiles created by munitions that utilize explosive detonations to form metal slugs. They may be struck by fragments generated by munitions such as artillery shells filled with explosives. Although not present on terrestrial battlefields, spacecraft are at continuous risk of impacts by projectiles such as dust and larger debris traveling at extremely high velocities. Regardless of their velocity, protection against projectiles is typically provided by armor.

Armor Including Multiple Layers

The current art for protection against supersonic projectiles usually involves armor consisting of at least two components. This is because homogeneous materials such as steel and ceramics typically require greater weight and thickness to stop a projectile than is required by armor assemblies utilizing two or more layers of different materials.

Considerable research and combat experience have consistently shown that the most efficient armors are made by joining a hard, dense impact surface or "strike face" to at least one backing layer that supports the first layer. To stop conventional projectile threats as exemplified by bullets and bomb fragments, ceramic strike faces are commonly used, but hard metal alloy strike faces also are effective in resisting many projectiles.

Hard strike faces increase likelihood that projectiles will shatter due to stress waves reflecting back and forth within them caused by impact. The fragments have much lower kinetic energy and momentum than the intact projectile. Early projectile disintegration enables load created by their impact to spread over a larger area within the armor, thereby reducing local stresses.

Hard, dense strike faces also serve to resist penetration for a longer time, thus allowing more momentum to be transferred from the projectile to the armor assembly. Longer residence or "dwell" time also allows local stresses generated by projectile impact to spread over a wider area. The result is similar to what occurs when incident projectiles shatter.

A wide range of materials and material combinations are employed as secondary or backing layers. Backing layers that resist bending are essential when ceramic strike faces are used because of the low tolerance for deformation inherent to ceramics.

Metal alloy and fiber-reinforced matrix composite materials are commonly selected as backing layers for both ceramic and metal strike faces. Composite materials typically offer higher strength to weight ratios than metal alloys, so composite backing layers are generally favored in applications where minimum weight is essential. Matrix materials may be organic resins such as epoxy and phenolic compounds, or alternatively may feature metals. Fiber materials range from graphite whiskers to organic fibers such as polyamides and modified thermoplastic resins such as polypropylene.

Despite the general effectiveness of armors made with the present art, numerous problems and shortcomings nonetheless remain. Projectiles with high kinetic energy often require unacceptably high weights of protective armor made with the current art to prevent penetration into people and aircraft, as well as into most vehicle types. High costs associated with ceramics and metal-matrix materials discourage their use in many applications. Other shortcomings become apparent when specific applications are examined.

If projectiles are sufficiently energetic, stress waves propagating in target materials will generate shear and compressive fractures. If penetration is resisted, stress waves may still produce severe deformation of the rear surface, resulting in a bulge, or so weakening the impact area that the armor will fail if another projectile strikes it.

If cracks propagate through the target, the rear surface (the surface opposite the impact surface) may detach or spall even if the projectile itself does not penetrate completely. Either spalling or complete penetration through shear failure in target materials is typical of dense projectiles having high length to diameter ratios (generally referred to as "long rod penetrators").

Stress waves propagating through armor are transmitted into people or other objects if they are in contact. Bulging of the armor's rear surface can perforate body tissue, as can spall generated by projectile impact on the strike face. All of these localized armor failures can inflict severe or lethal injury to people and serious damage to equipment, even when incident projectiles fail to penetrate.

Sniper bullets fired by ordinary rifles typically use bullets with cores consisting of tungsten carbide or steels with high degrees of hardness. Protecting only the chest and torso of a soldier against such bullets requires armor using the current art significantly exceeding five kilograms. Helmets with this level of protection would be too heavy for necks and shoulders to support if made using the current art.

The large vulnerable area of aircraft and vehicles, combined with the weight of armor made with the current art that is required to stop projectiles typically threatening these targets, force designers to limit armor usage in order to leave weight and space available for fuel and payloads. Projectiles typically fired at aircraft, vehicles and naval vessels are larger than those fired from rifles. Larger projectiles often have explosive fillings and other features that enhance penetrating capability beyond what is possible with small arms. The difficulty of resisting penetration is magnified when both mass and velocity of threat projectiles increases.

The unanswered challenges posed by current projectile threats are retarding the development of new vehicles and aircraft as designers struggle to meet performance and mission requirements while providing adequate protection. For the foregoing reasons, many potential users would welcome new materials and armor assemblies that would prevent projectile penetration with significantly less weight and with thickness no greater than required with armors of the present art.

Through recent material and design innovations, means for achieving the desired objectives are now available. These means involve proper selection and arrangement of suitable materials in novel ways. Innovative means of mounting the armor assembly variants that are part of the invention can further enhance projectile penetration resistance and well as mitigate shock associated with projectile impact.

Strike Face Materials

Ceramic strike faces typically possess higher hardness levels than are achievable with most metals. Hardness and material strength are important to resisting penetration by relatively small projectiles traveling at velocities on the order of 1 kilometer per second (km/s). Against pointed projectiles, ceramic strike faces generally extend the time of contact prior to penetration longer than occurs with metal strike faces.

Ceramics available currently are generally less dense than steel and at least as hard. As noted heretofore, ceramics also offer characteristically high acoustic speeds. This is important for rapidly dissipating projectile energy and localized contact stresses under the point of impact. The acoustic speed of alumina, for example, is approximately 10 kilometers per second. This is roughly twice the acoustic speed of steel, and 70% higher than for aluminum.

Ceramic strike face materials have drawbacks that affect performance and usage, however. Generally, ceramics are quite expensive. This is particularly the case for ceramics designated as "armor grade" silicon carbide, titanium diboride, tungsten carbide and alumina. These ceramics require careful process control during manufacturing processes that occur at high temperatures, and thus are prone to inconsistent properties between one batch and another of the same nominal composition.

Low bending tolerance inherent to all ceramics currently used in armor was noted previously. Another significant risk is that cracks may form in ceramics that have been dropped without the user knowing that penetration resistance has been degraded. This vulnerability is particular significant when the threat of multiple projectile impacts on ceramic armor is present.

Ceramics typically cannot withstand repeated projectile impacts within 2 centimeters of a previous hit. Ceramics are also less effective than metal when struck by blunt or flat projectiles. Furthermore, ceramics are particularly sensitive to impacts by explosively formed penetrators, or "EFPs".

Among commonly used ceramic armor materials, all but tungsten carbide armors tend to shatter or disintegrate into small particles (comminute) at high projectile impact velocities. Shattering negates the advantage of high acoustic speed because stress waves reflect at the new boundaries created by the cracks. Stress waves emanating from the projectile impact zone thus cannot dissipate into surrounding ceramic material.

Despite the heavier weight required, metals offer some advantages over ceramic strike faces. Most metals resist shattering under projectile impact. Certain steels can be processed in ways that provide them with high degrees of hardness and high tensile strengths while being somewhat more resistant to bending stresses. Iron alloys with significant additions of chromium and molybdenum also display both hardness and tolerance for localized bending. Mechanical properties of metal armor components are typically not degraded by subsonic collision impact. Structures are generally able to support the extra weight involved with use of metal strike faces.

Although expensive, tungsten offers particular advantages. It is strong but is more dense than steel. High density is important because of a quality called impedance. Impedance is defined as the mathematical product of density and velocity of the shock wave as it travels through the material. When the impedance of the target is higher than that of the projectile, the contact load at the impact surface is substantially reduced. This happens because shock waves generated within both the target and the projectile reflect from their surfaces, which sends negative pressure or relaxation waves back to the impact surface within the material possessing higher impedance.

As is the case with ceramics, hard metal strike faces also have their shortcomings. In addition to unfavorable comparisons with respect to weight and hardness, performance advantages of tungsten and tungsten alloys are often offset by costs and limitations in supply. Supply of other dense metals with high strength such as tantalum is far too small to consider in armor. As also noted previously, only tungsten has an acoustic speed nearly as high as that of most ceramic materials.

DISCLOSURE OF THE INVENTION

In view of the shortcomings of armors to adequately resist penetration utilizing materials in assemblies made using the current art, novel means are required. The present invention accordingly offers a means for providing resistance to penetration by projectiles traveling at very high velocities while reducing localized impact stresses, minimizing deformation of the armor's surface opposite that of impact, and otherwise reducing damage to target material.

More specifically, the invention provides a means for substantially reducing deformation of the rear surface of armor caused by projectile impacts as well as prevention of penetration. The invention accomplishes reduced deformation of the rear surface and increased resistance to penetration whether the assemblies are flat or curved.

As discussed in greater detail elsewhere, the present invention contemplates an assembly including an impact surface or strike face layer comprising an organic resin composite into which multitudinous ceramic shapes are distributed, a secondary or transition layer to provide mechanical support to the strike face and distribute the imposed load over a wider bearing area, a spacer layer that facilitates reflection of stress waves in the assembly layers between the space and incident projectile, and a back surface that defines the space as well as intercepts any projectile or projectile fragments transiting the space so defined. To this basic assembly can be added components that increase deformation and deflection of incident projectiles, reduce transmitted stresses, or strengthen at least one of the layers.

Alternative embodiments enable allow small rotations and displacements of components that enhance energy dissipation from and tumbling of impinging projectiles. Additional embodiments provide better protection of the assembly against the environments in which they may be employed, as well as special adaptations for armor assemblies to be worn by humans and for employment as protection for vehicles.

Objects and Advantages

Accordingly and in view of the above summary, the invention has a number of objects and advantages set forth as follows:

(a) to reduce the weight of armor required to stop projectiles having specified masses and velocities;

(b) to prevent significant shock transmission into the target protected by the armor assembly;

(c) to protect people wearing the armor assembly from trauma induced by projectile impact;

(d) to rapidly distribute shock wave and pressure loads transverse to the initial direction of these waves so as to reduce local stresses within armor assemblies;

(e) to encourage deflection and tumbling of impinging projectiles regardless of the angle of incidence;

(f) to produce armor assemblies that are lower in cost yet more capable of preventing penetration by projectiles of specified mass and velocity compared to any other armor made with the present art;

(g) to circumvent reliability and quality control problems inherent to ceramic components in armor systems;

(h) to enable embodiments to be readily fabricated as separate assemblies that can be affixed to a wide variety of existing vehicles and aircraft or alternatively be integrated into new designs;

(i) to provide resistance to penetration by explosively formed penetrators and shaped charge jets in compact armor assemblies that are also effective against other projectile threats; and (j) to provide armor that provides survivability for humans against substantially heavier projectiles impacting at higher velocities than is offered by any personnel armor made using the current art, The invention disclosed herein circumvents numerous shortcomings of existing armor materials and armor assemblies. In addition, the invention creates numerous opportunities for providing protection against severe projectile threats through novel utilization of materials available currently and those that may be developed in the future, alone or in combination with other materials.

These materials can be beneficially used in many different configurations to achieve desired protection against projectiles created by munitions and natural phenomena such as micrometeorites. Further objects and advantages will become apparent upon consideration of the drawings and description of the embodiments of this invention; however, not every embodiment achieves every object or advantage.

Figure 1:
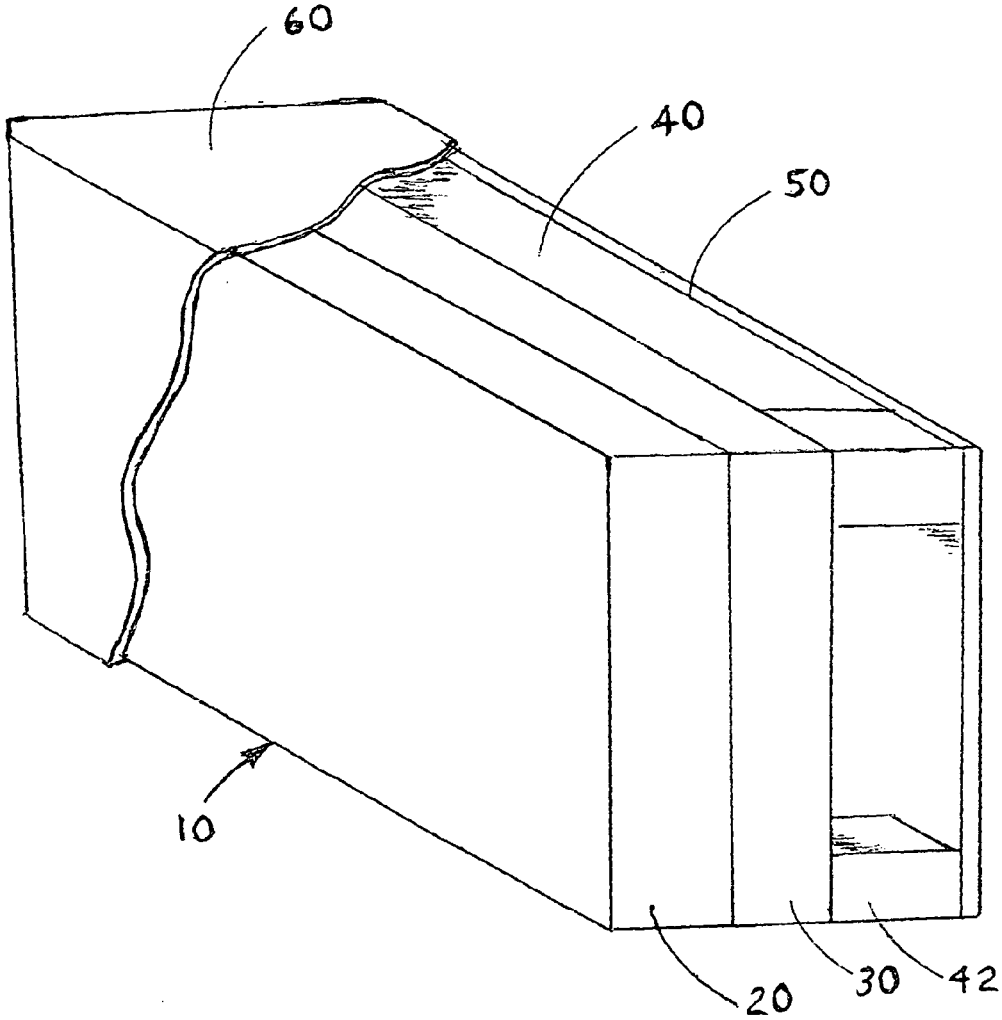
FIG. 1 depicts the basic embodiment of the armor assembly.

| Reference Numerals in Drawings | |
|---|---|
| 10 assembly | 36 resin matrix |
| 20 strike face layer | 38 stress distributor |
| 22 resin matrix | 39 aerogel layer |
| 24 fiber reinforcement ply | 40 void space |
| 26 deflecting components | 42 deformable spacer |
| 27 adhesive | 44 metal foam |
| 30 transition layer | 46 adhesive |
| 32 adhesive | 50 backing layer |
| 34 fiber reinforcement ply | 60 seal |
| 70 support assembly | 80 cushion component |

MODES FOR CARRYING OUT THE INVENTION

The various drawing figures accordingly depict a number of embodiments according to the present invention. Those embodiments are summarized below followed by a more detailed description of the respective figures.

FIG. 1 shows a preferred embodiment of the armor assembly. The armor assembly 10 has a first layer, a strike face layer 20 oriented toward the anticipated direction of approach for a projectile. A transition layer 30 provides mechanical support for the first layer, removes additional kinetic energy from impacting projectiles, and redistributes stress waves generated by projectile impact substantially transverse to projectile motion. Adhesive 32 bonds the strike face and transition layers. A void space 40 is created by at least one deformable spacer component 42 between the transition layer and a backing layer 50. An optional seal 60 is depicted that encapsulates the entire armor assembly.

Figure 2:
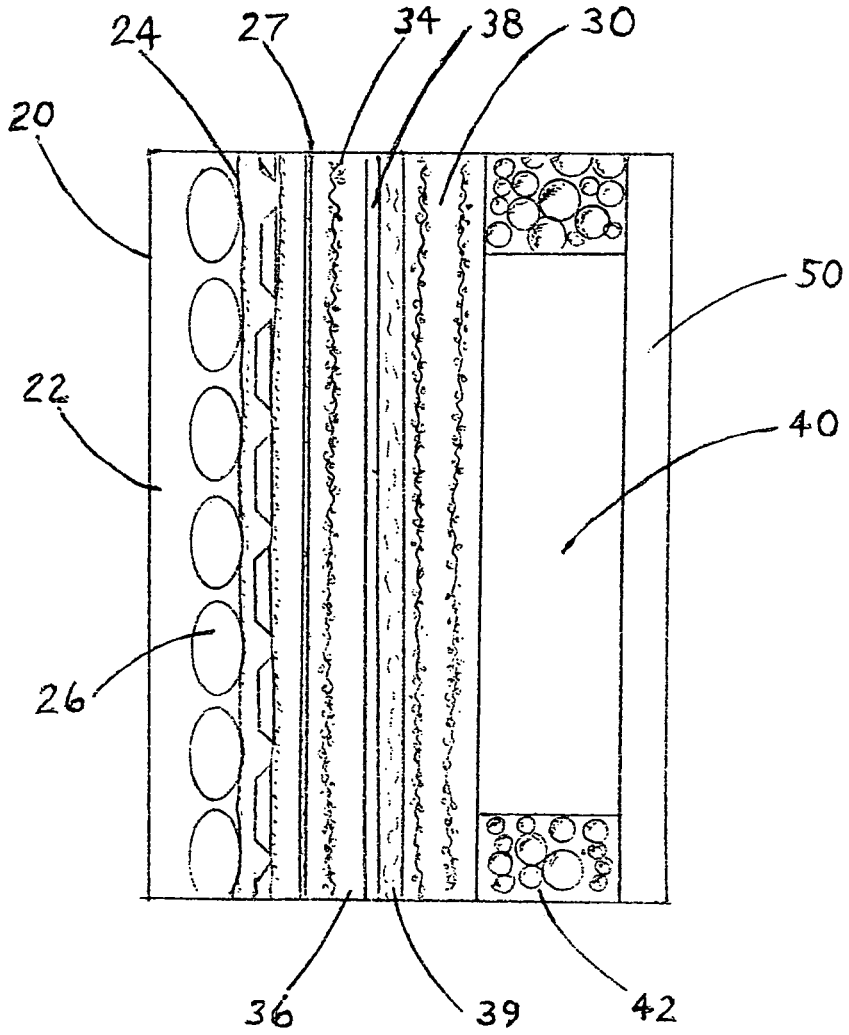
FIG. 2 shows a cross section of one embodiment of the invention, with a strike face featuring three layers affixed to the transition layer, and an aluminum component embedded inside the transition layer and aluminum foam used as a spacer.

FIG. 2 is a cross section that shows the internal structure of the layers featuring the armor assembly. The strike face layer includes a resin matrix 22 in which at least one fiber reinforcement ply 24 is embedded. Multitudinous deflecting components 26 are bonded to each woven fabric layer. If additional plies are included, these may use identical deflecting components or instead may use different shapes and sizes of deflecting components.

Alternative embodiment resins are phenolics. The resin may be modified by introducing multitudinous glass or plastic microspheres. Nanoparticles may be dispersed throughout the resin as another alternative embodiment, either with or without the presence of microspheres.

Fiber reinforcement plies may be glass. Alternative embodiments would use fiber reinforcement plies including carbon, aramid, polyethylene, polypropylene, or aromatic polyester. Where more than one ply is used, the additional plies can be different from one another, with respect both to weave structure, fiber thickness and fiber material.

The deflecting components may be alumina. Many embodiments would utilize deflecting components that have barrel shapes or similar, such as barrels, boules, ovoids, rhomboids, ellipsoids and the like. Alternative materials for the deflecting components include silicon carbide, titanium diboride and tungsten carbide. Deflecting components can be at least 5 millimeters long and at least 3 millimeters in thickness.

The transition layer preferably features at least one fiber reinforcement ply 34 embedded in a resin matrix 36. An alternative embodiment features a transition layer including a stress distributor 38 between fiber-reinforced resin components. The stress distributor is preferably a material having an acoustic speed at least 6 kilometers per second, such as aluminum and ceramic materials. Yet another alternative embodiment would be to utilize a stress distributor contiguous with an aerogel layer 39 that is disposed toward the surface closer to the void space layer.

Alternative embodiments include laminates of layers utilizing different matrix resins and different fiber reinforcement plies. The transition layer surface contiguous with the void space may be parallel with respect to the strike face layer surfaces. In alternative embodiments, the transition layer surface is inclined.

At least one deformable spacer 42 creates a void between the transition layer and backing layer 50. The deformable component may yield at a load substantially less than a load likely to inflict unacceptable harm to the object or person being protected by the armor assembly.

One embodiment employs numerous deformable components that leave an intervening void that can be occupied by air or other gas, or alternatively a partial or complete vacuum. Another embodiment is substantially filling the void space with aerogel. Aerogel can be in various forms, including multitudinous loose spheres, beads or agglomerations, or cast in a polymeric matrix. Yet another alternative embodiment uses an aluminum foam component 44 as a deformable spacer. Multitudinous voids filled with air serve as the void contemplated as the void space.

Deformable components may be elastomeric shapes. Alternative deformable components may include reinforcements such as glass fibers. Deformable components may be toroids, rods, volutes, turbinate forms, strips or disks. Rods, strips and disks may be made from aluminum foam plates.

Deformable spacers may be uniform or alternatively may feature different materials. If elastomeric, spacers having different spring constants can be used. Coiled wire springs may also serve in this role.

The backing layer preferably includes a material or composite assembly having sufficient resistance to penetration by any projectile that transits the transition layer and void space. In alternative embodiments, the backing layer may be parallel with the strike face layer or may be disposed at an inclined angle with respect to the transition layer.

The backing layer may alternatively be formed into a more complex shape, with curves of varying radii of curvature. A portion of an object to be protected, such as a structure or vehicle, may serve as the backing layer.

Figure 3:
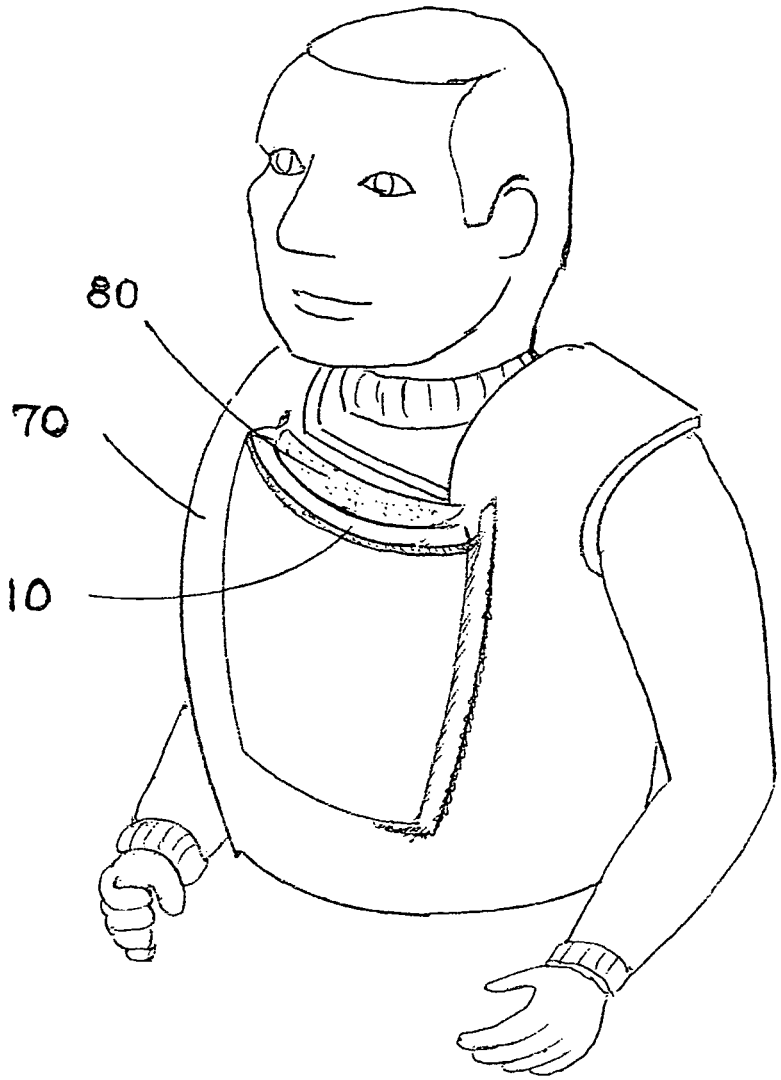
FIG. 3 depicts an embodiment of the invention used to protect a person.

FIG. 3 depicts an armor assembly protecting a person. At least one armor assembly of the present invention is affixed to a support assembly 70. Armor assemblies used for protecting people could be formed into a wide range of shapes and profiles.

Alternative embodiments would enable a person to be worn as a pullover or as an attachment to an undergarment. At least one cushion component 80 could optionally be used to improve comfort and to further diminish impact trauma to the wearer caused by projectile impact.

Advantages

The invention offers numerous alternatives for a person skilled in the art to design and armor products that protect against a wide range of threat projectiles. Effective assemblies can be made from materials and using fabrication processes already in the current art. New materials and fabrication processes may be developed in the future that could further enhance capabilities within embodiments discussed elsewhere.

All embodiments would increase the extent of ballistic protection possible over any means available in the present art for a specified weight and a specified thickness of protective material. This advance in capability would make ballistic protection possible in many more applications where weight and space constraints prevent employment of effective assemblies using the present art.

Operation

The armor assembly, such as that shown in FIG. 1, becomes operable when a projectile strikes the first layer. Compression waves, then relaxation waves spread away from the point of impact as well as in the direction of projectile motion through the first layer and into the second layer.

The multitudinous deflecting components inside the resin matrix produce an irregular surface that ensure oblique impact by impinging projectiles. Oblique impact on hard, dense deflecting components induces tumbling of incident projectiles. This, in turn, creates a momentum change and increases the projectile surface area attempting to pierce the strike face layer.

The hard, dense deflecting components also deform the projectile, further reducing its penetrating ability. The deformed, deflected projectile must then push the deflecting components that it strikes through the fiber reinforcement ply or plies. Kinetic energy of the projectile is thus considerably reduced in the strike face layer and transit time through it is increased. The above process is repeated through each successive layer of deflecting components bonded to additional fiber reinforcement plies.

If projectile velocity exceeds the acoustic speed of the first and second layers, shock waves will propagate. This situation is typical for superplastic metal jets produced by shaped charge devices. Use of ceramic and metal components having high acoustic speeds and densities greater than densities of impacting projectiles and jets will accomplish substantial stress wave and shock wave propagation essentially transverse to projectile motion. All of the alternative embodiments of the strike face layer include components characterized by high densities and high acoustic speeds.

Transverse stress and shock wave propagation will greatly increase the bearing'area that resists the load generated by the projectile. This, in turn, will substantially reduce local stresses and minimize degradation of the armor material properties.

Stress waves propagating through the transition layer will reflect at the surface bordering the space. The rear surface of the transition layer will bulge locally into the void space in front of the projectile. If the strike face and transition layers delay penetration for a sufficient length of time, they will induce elastic and possibly plastic deformation of the deformable spacers that create the void space.

The longer the transit time for the projectile within the strike face and transition layers, the greater is the reduction of localized stresses in these components. This is because relaxation waves are reflected at the transition layer/void space boundary and travel opposite the motion of the projectile. The slower the projectile's velocity, the longer is the time allowed for relaxation waves to spread through the materials compressed by projectile penetration.

Regarding projectiles and fragments, deeper penetration is more likely if stresses in the target material area are localized. Conversely, rapid propagation of shock waves transverse to projectile travel will reduce local stresses. All embodiments of the present invention accomplish rapid propagation laterally of transmitting stress and shock waves.

This desirable phenomenon is enhanced by insertion of the optional stress distributor. It is further enhanced by employing an aerogel layer immediately behind the stress distributor. The acoustic and shock wave speeds of aerogel materials are substantially less than characteristic of other materials. Compression waves propagating in the direction of the projectile are further decelerated in the aerogel. These waves are reflected back at the rear surface of the stress distributor as relaxation waves, thereby reducing compression stress in that layer. Optional use of the aerogel layer disposed in this manner gives more time for compression waves to propagate away from projectile impact areas, followed quickly by the relaxation waves.

The armor assembly may be supported to serve as a barrier. It may alternatively be mounted to a structure, a person, a vehicle, an aircraft, or space vehicle by numerous means. The armor assembly could be allowed to bounce or displace substantially in the direction of the impinging projectile's motion.

Research and experimentation have shown that allowing such displacement increases projectile transit time, thereby facilitating more momentum transfer from the projectile into the entire target assembly. Reducing velocity from the projectile significantly reduces its penetrating capability. This is particularly important when the initial projectile velocity exceeds the acoustic speed of the armor assembly materials.

One particular embodiment of the present invention has been subjected to multiple tests against supersonic projectiles. This embodiment uses a strike face layer designated "Deflection Independent Impact Zone", or "Diiz". Tests with the Diiz strike face layer have consistently shown that projectiles either stop in the strike face or bounce back toward the direction of origin. Test projectiles have included 7.62×39 mm, 7.62×63 mm, and 0.50 caliber (12.7 mm) with tungsten carbide cores. Tested armor assemblies had total densities of approximately 0.4 grams per cubic centimeter.

Diiz strike face layers utilize barrel-shaped alumina deflecting components that are selected according to the diameter of projectiles whose penetration must be arrested. Against 7.62 mm diameter projectiles, deflecting component diameters are typically between 10 and 15 mm in characteristic dimensions. Against 12.7 mm projectiles, deflecting component diameters are typically between 15 and 25 mm. When numerous projectiles must be stopped that may have a range of diameters, such as bursting munitions, then a range of deflecting component characteristic dimensions may be employed.

Metal foam, particularly aluminum foam, serves to further transmit stress and shock waves laterally while reducing their transmission in the direction of projectile travel compared with homogeneous metal identically disposed. Multitudinous free surfaces between the aluminum and air present within metal foam generate innumerable stress and shock wave reflections. These reflections serve to dissipate projectile energy. They also create stresses internal to the projectile and thereby facilitate damage to it. Additionally, metal foams will yield locally, which will facilitate further tumbling and deflecting the projectile.

Armor assemblies may be sealed to prevent ingress of fluids and to facilitate cleaning. Fluid ingress into the void space is particularly to be avoided. A wide range of elastomeric and other coatings may be used to seal or encapsulate armor assemblies according to the present invention. Seals may combine other uses, such as to provide camouflage, to add decorative qualities, or to add structural integrity to the complete assembly.

The use of elastic support components helps prevent projectile penetration in several ways. Elastic support components may be attached to a frame and the armor assembly by a wide variety of means. These components may be essentially parallel, or alternatively overlap in a wide range of patterns. Alternatively, these components may be strengthened through use of fibers or wires that add considerable strain energy when projectile loads acting laterally work to stretch the elastic components. Elastic and tensile properties enable designers skilled in the art to optimize energy dissipation and momentum transfer through alternatives available through the present invention.

By generating sufficient dwell time with the first two layers, substantial momentum can be transferred from the projectile to the armor components and armor assembly as a whole. When a range of projectile threats must be resisted, armor assemblies each having a mass approximating a projectile of concern may be put together in such a way that the different assemblies could move independently of one another.

Ramifications and Scope

Accordingly, the reader will observe that assemblies made through this invention would offer substantial protection from projectiles of all types to people, buildings, vehicles; aircraft, barriers and other objects. Embodiments of this invention make protection possible against a wide range of munitions and devices that generate projectiles and fragments.

Many other possibilities for preventing penetration by projectiles through the present invention than those described and illustrated above can be made by a person skilled in the art. The above embodiments are not intended to limit the application of concepts described above.

Variations and modifications in addition to those described above are believed obvious from the description. Accordingly, the scope of the invention is defined only by the following appended claims which are further exemplary of the invention.

What is claimed is:

1. An armor assembly for stopping an impinging projectile, comprising:

(a) a first strike face layer having a front surface oriented toward the anticipated direction of the projectile, said strike face layer comprising a resin matrix, at least one fabric ply, and multitudinous deflecting components arranged to encourage deflection of the impinging projectile, wherein said (i) at least one fabric ply and (ii) said multitudinous deflecting components are embedded therewithin and substantially bonded to said resin matrix, and said multitudinous deflecting components are bonded to said fabric ply, said multitudinous deflecting components each having a characteristic dimension of at least three millimeters;

(b) a transition layer bonded to a rear surface of said strike face layer, said transition layer comprising a resin matrix in which a plurality of fabric plies are embedded therein and substantially bonded to said resin matrix;

(c) a backing layer; and (d) a void space layer created and maintained by at least one deformable spacer component placed between said backing layer and said transition layer, said deformable spacer component attached to said backing layer.

2. The armor assembly of claim 1, wherein said multitudinous deflecting components on one fabric ply are dissimilar in characteristic dimensions to the characteristic dimensions of deflecting components substantially bonded to at least one other fabric ply embedded in the strike face layer.

3. The armor assembly of claim 1, in which at least one fabric ply substantially comprises glass fibers.

4. The armor assembly of claim 1, further comprising a seal surrounding said armor assembly, said seal comprising a material that is substantially impervious to penetration by fluids.

5. The armor assembly of claim 1, further comprising multitudinous nanoparticles substantially distributed throughout the resin matrix in the strike face layer.

6. The armor assembly of claim 1, in which the surface of the transition layer facing the void space is inclined with respect to the surface of the strike layer that is contiguous with opposite surface of the transition layer.

7. The armor assembly of claim 1, in which the multitudinous deflecting components substantially comprise a ceramic material.

8. The armor assembly of claim 2, in which the multitudinous deflecting components bonded to at least one fabric ply substantially comprise a ceramic material.

9. The armor assembly of claim 3, in which the surface of the transition layer facing the void space is inclined with respect to the surface of the strike layer that is contiguous with opposite surface of the transition layer.

10. The armor assembly of claim 3, further comprising a second transition layer sandwiching a stress distributor component having an acoustic speed at least 6 kilometers per second, said stress distributor component being at least 1 millimeter in thickness between 2 layers comprising at least one fabric ply embedded in a resin matrix.

11. The armor assembly of claim 3, in which at least one deformable spacer component substantially comprises aluminum foam.

12. The armor assembly of claim 3, in which at least one deformable spacer component is displaced further than at least one other deformable spacer component when subjected to the same force.

13. The armor assembly of claim 3, in which the backing layer is inclined with respect to the surface of the strike layer that is contiguous with the opposite surface of the transition layer.

14. The armor assembly of claim 4, in which the multitudinous deflecting components substantially comprise a ceramic.

15. The armor assembly of claim 7, in which the backing layer is inclined with respect to the surface of the strike face layer that is contiguous with a surface of the transition layer.

16. The armor assembly of claim 7, further comprising a seal surrounding said armor assembly, said seal comprising a material that is substantially impervious to penetration by fluids.

17. The armor assembly of claim 7, wherein a portion of an object to be protected by said armor assembly serves as said backing layer.

18. The armor assembly of claim 7, in which at least one of the multitudinous deflecting components comprised of ceramic has a barrel shape.

19. The armor assembly of claim 10, in which the stress distributor component substantially comprises aluminum.

20. The armor assembly of claim 10, in which the stress distributor component comprises aluminum foam.

21. The armor assembly of claim 10, further comprising an aerogel component that is substantially bonded to the surface of the stress distributor component furthest from the strike face layer.

22. The armor assembly of claim 16, further comprising a support assembly to which is substantially attached said armor assembly, said support assembly arranged so as to enable a person to wear said support assembly with said armor assembly substantially attached thereto.

23. The armor assembly of claim 21, further comprising at least one cushion component that reduces pressure transmitted to a person wearing said armor assembly when a projectile impinges upon the armor assembly.

24. A method of making an armor assembly for defeating an impinging projectile, comprising:

(a) providing (i) a strike face layer having a front surface oriented toward the anticipated direction of the projectile, said strike face layer comprising a resin matrix, at least one fabric ply, and multitudinous deflecting components arranged to encourage deflection of the impinging projectile, wherein said at least one fabric ply and said multitudinous deflecting components are located within said resin matrix and substantially bonded to said resin matrix, and said multitudinous deflecting components are bonded to said fabric ply, said multitudinous deflecting components each having a characteristic dimension of at least three millimeters; (ii) a transition layer comprising a resin matrix in which a plurality of fabric plies are embedded therein and substantially bonded to said resin matrix; (iii) a backing layer; and (iv) at least one deformable spacer component;

(b) bonding a front surface of said transition layer to a rear surface of said strike face layer;

(c) placing said at least one deformable spacer component between said backing layer and a rear surface of said transition layer, thereby creating a void space layer between said backing layer and said transition layer; and (d) attaching said at least one deformable spacer component to said backing layer.

* * * * *